United States Patent [19]

Schubernig et al.

[11] Patent Number: 4,848,224

[45] Date of Patent: Jul. 18, 1989

[54] PRESS

[75] Inventors: Alexander Schubernig, Frohnleiten; Peter Blünegger, Hitzendorf, both of Austria

[73] Assignee: Maschinenfabrik Andritz Actiengesellschaft, Graz, Austria

[21] Appl. No.: 180,733

[22] Filed: Apr. 12, 1988

[30] Foreign Application Priority Data

Apr. 13, 1987 [AT] Austria ..... 922/87

[51] Int. Cl.[4] ..... B30B 9/24

[52] U.S. Cl. ..... 110/118; 100/153; 210/386; 210/400; 162/360.1; 29/121.5

[58] Field of Search ..... 100/118, 119, 120, 121, 100/153, 154, 157; 162/360.1; 210/386, 400, 401; 29/121.1, 121.5

[56] References Cited

U.S. PATENT DOCUMENTS 3,896,030 7/1975 Bahr ..... 210/386
3,973,483 8/1976 Appenzeller ..... 162/360.1

FOREIGN PATENT DOCUMENTS 1064398 8/1959 Fed. Rep. of Germany ..... 29/121.5
1572731 8/1980 United Kingdom ..... 210/400

*Primary Examiner*—Peter Feldman
*Attorney, Agent, or Firm*—Townsend & Townsend

[57] ABSTRACT

The invention relates to a press consisting of at least one, conveniently perforated and hollow, rotatable drum as well as press rollers with axes parallel in relation to the drum axis acting against the outer shell of the drum, with at least one web of material to be pressed made to pass between said drum and the aforementioned rollers, conveniently supported by one of two screen belt(s) or the like. The invention is particularly characterized in that the axes of the press rollers disposed on the outer circumference of the drum are connected via articulated or resilient traction elements, in particular chain links, plate chain links or the like, whereby a press jacket, in particular in the form of a roller chain, is formed and that anchorages are connected, conveniently articulated, on the ends of said systems formed of traction elements and press roller axes, said anchorages being capable of exerting forces, in particular tension forces, on said traction elements for changing the distance between said press jacket, in particular the roller chain, or its press rollers, and the outer circumference of the drum.

20 Claims, 3 Drawing Sheets

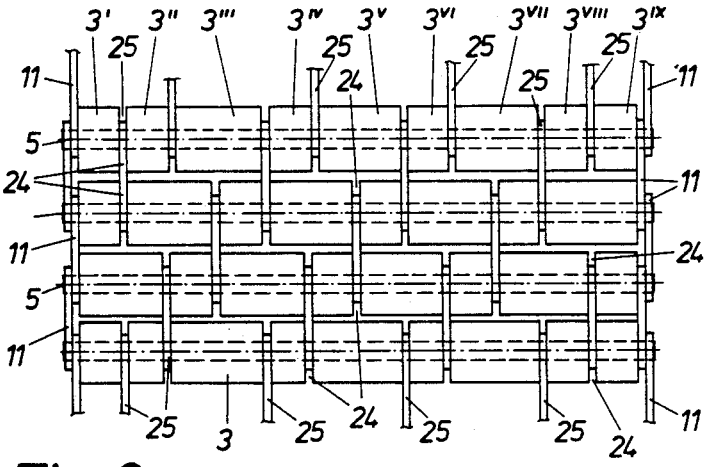
Fig. 2
Fig. 3
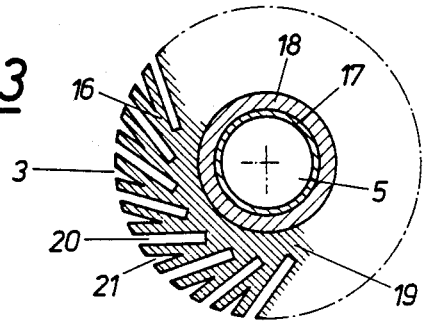
Fig. 6
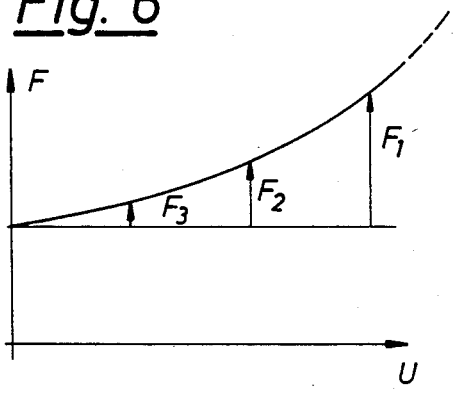
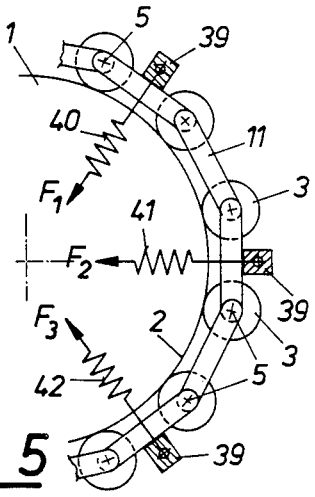
Fig. 5

PRESS

The invention relates to a press consisting of at least one, conveniently perforated and hollow, rotatable drum preferably centrally located within the press as well as press rollers with axes parallel in relation to the drum axis acting against the outer shell of the drum, with at least one web of material to be pressed, in particular to be dehumidified, made to pass between said drum and the aforementioned rollers, conveniently supported by one or two screen belt(s) or the like, in particular an additional press for the separation of solids and liquids from soild/liquid mixtures, for instance press cakes, present in predehydrated form, for instance as predehydrated pulp suspension in papermaking, in particular disposed downstream of a prepress, any given types of solid/liquid separating units, mainly a screen belt press, conveniently a double screen belt press, which advantageously operates continuously.

In known presses of the aforementioned type, the press rollers are individually pressed against the drums, in particular perforated drums. Since these press rollers act on the screen belts and the material to be pressed only at individual locations of the drum circumference, the pressing effect and the degree of dehydration or dehumidification is limited. In addition, the known press rollers are only supported on their ends, so that the contact pressure force cannot be increased at will in view of the hazard of the sagging of the rollers.

The disadvantages previously mentioned are avoided according to the invention by providing for the axes of the press rollers disposed on the outer circumference of the drum to be connected via articulated or resilient traction elements, in particular chain links, plate chain links or the like, whereby a press jacket, in particular in the form of a roller chain, mainly of the type of a plate link chain and adaptable to the outer circumference of the drum is formed of the rollers and said traction elements and that anchorages are connected, conveniently articulated on the ends of these systems or chains formed of traction elements and press rollers, said anchorages being capable of exerting forces, in particular tension forces, on said traction elements for changing the distance between said press jacket, in particular the roller chain, or its press rollers, and the outer circumference of the drum, so that the contact pressure of the rollers on the screen belts and the web of material lodged therebetween and on the drum shell can be established, maintained and adjusted (controlled).

In this way, the pressing forces can be distributed over large portions of the circumference of the, in particular centrally located, perforated drum; a particularly good control of the contact pressure force, in particular on the screen belts and thus the material to be pressed, can be obtained this way. The press according to the invention can be operated as an independent apparatus with an appropriate material feeding device; the press according to the invention could also be integrated into a screen belt press or a vacuum filter or the like.

An even better distribution of the pressing forces can be obtained if the press rollers are provided with an elastically yielding surface formed of lamellas approximately extending in the direction of the generatrix of the roller shells. The forming of the press rollers with a segmented, resilient surface instead of the use of rigid press rollers results in a tabular pressing zone due to the occurring elastic deformation of the press roller surface on pressing against the screen belts or the perforated drum instead of the known linear pressure with hard press roller surface. Lamella rollers of this type are also suitable for use in screen belt presses such as those which could for instance be provided upstream of the additonal press according to the invention as prepresses.

The invention may be further developed with great advantage by supporting two or more partial rollers side by side in the direction of the drum generatrix on indidivual, several or all the roller axes, partial gaps between such partial rollers conveniently being aligned with the partial gaps of immediately adjacent rollers or partial rollers and intermediary traction elements, in particular intermediary chain links, intermediary plate chain links or the like connecting, in particular articulating, adjacent roller axes in the area of the aligned partial gaps. The division of the roller length thus obtained and the interposed transmission of tension forces and thus of the contact pressure forces over the length of the drum or its generatrix permits the exertion of higher specific pressing forces. This effect and the control possibilities can be further increased by providing for some of the partial rollers of adjacent pairs of rollers to be of different lengths so that the partial gaps of adjacent pairs of rollers are mutually staggered.

On principle, plants with the press according to the invention may be laid out according to the following main points of view: The lower or outer screen belt or the like or the upper or inner and the lower or outer screen belt or the like which are made to pass between the drum and the roller chain or the like may constitute an extension of the corresponding screen belt(s) of the prepress. In this variant, the web material or the press cake is supported at least after prepressing during its conveying by the lower screen belt or the like to the press according to the invention for afterpressing. If the consistency or strength of the prepressed material to the press according to the invention is already adequate, the press can be formed as an independent unit and as a result, at least the upper or inner screen belt or the like can be made to pass in a separate cycle in this independent press unit.

In a practical embodiment of the invention, the anchorages for the ends of the traction elements are conveniently connected to pneumatic or hydraulic cylinders, which permits a control or change of the traction forces acting on the press jacket, in particular on the roller chain, and thus of the compression forces acting on the screen belts or the like or the web of material or the press cake. An additional control possibility or a further increase of the pressing forces can be achieved if in addition, press clamps or the like act on the press jacket, in particular the roller chain, spacially from its end for the purpose of additional change or increase or control of the contact pressure forces, so that a progressive course of the pressure-time-curve can be obtained.

The invention is explained by means of exemplary embodiments under reference to the accompanying drawing.

FIG. 2 shows a partial view of the roller chain in unwound form;

FIG. 3 shows a sectional view of a press roller with lamellar coating of plastic material;

FIG. 5 is a diagrammatic partial side elevational view of an embodiment provided with additional compression elements betwen the ends of the roller chain; and FIG. 6 shows a diagrammatic view of the progressive compression increase obtainable thereby.

Figure 1:
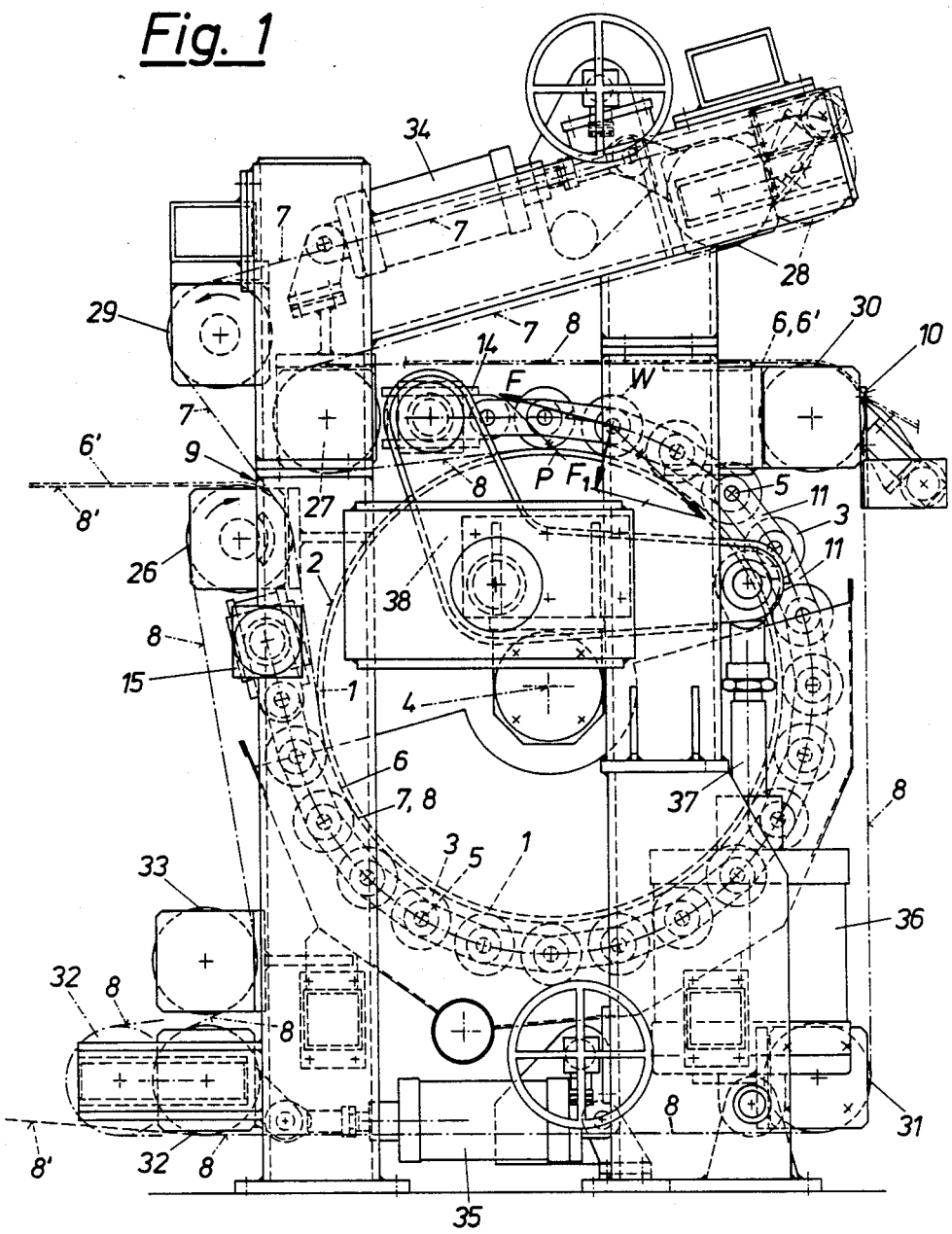
FIG. 1 is a diagrammatic side elevational view of two variants of the invention.

As mainly shown by FIG. 1, the press according to the invention, in particular an additional press disposed downstream of a screen belt press, consists of a perforated, rotatable, hollow drum 1 disposed centrally within the press as well a press rollers 3 acting on its outer shell 2 with axes 5 parallel in relation to the drum axis 4. A web of material 6 to be dehydrated or dehumidified and two screen belts or the like 7,8 supporting the web are made to pass between the drum 1 and the press rollers 3. The web of material 6 is conveyed to the press for instance after prepressing, predehydration or predehumidification. This conveying can be effected in the most diverse ways, for instance according to FIG. 4 from a double screen belt press serving for prepressing or predehydration via screen belts 7″, 8″ or, as shown in FIG. 1 in broken lines, via a single lower or outer screen belt 8′.

In the variant emphasized in FIG. 1, the press cake is fed from a screen belt press disposed upstream or from another solid/liquid separation unit at 9 between the screen belts 7,8 independently circulating in the press. The dehydrated material web is discharged at 10.

According to the invention, the axes 5 of the press rollers 3 disposed on the outer circumference 2 of the drum 1 are connected by means of articulated chain links or plate chain links 11, whereby a roller chain, mainly of the type of a plate link chain, adaptable to the outer circumference of the drum 1, is formed. Articulated to the ends 12, 13 of this roller chain or the traction systems formed of plate chain links 11 and the press roller axes 5 are anchorages 14, 15 by means of which tension forces may be exerted on the roller chain 3,5,11 for changing or maintaining the distance between the roller chain and its press rollers 3 and the outer circumference 2 of the drum 1. By this, the pressing of the rollers 3 on the screen belts 7,8 and the web of material 6 lodged therebetween and on the drum shell 2 can be established, maintained or adjusted.

As shown in the sectional view of FIG. 3, the press rollers can be provided with an elastically yielding surface 16 in order to increase their pressing surface area. For this purpose, a liner 17 and onto this a roller pipe 18 provided with an elastic roller coating 19 of plastic material or the like is pulled over the press roller axis or the chain bolt 5. The outer surface of this coating is provided in this case with lamellas 22, 23 formed by corresponding notches 20, 21 extending in the direction of this generatrix, whereby the desired elastic resilience of the roller surface is obtained.

As shown, for instance, in FIG. 2 in partial plan view of the roller chain in unwound form, two or more partial rollers 3, 3′, 3‴, 3⁗ and so forth can be supported side by side viewed in the direction of the generatrix of the drum 1 on individual or several or all of the axes 5 of the rollers 3, the partial gaps 24 of immediately adjacent rollers or partial rollers 3, 3′, 3‴ and so forth being aligned and intermediary plate chain links 24 mutually articulating adjacent roller axes 5 in the area of the aligned partial gaps 24.

The partial rollers 3, 3′, 3″, 3‴ and so forth of adjacent pairs of rollers 3 may be of different lengths so that the partial gaps 24 of adjacent pairs of rollers 3 are mutually staggered.

In view of the division of the roller length thus obtained and the interposed transmission of the tension forces and thus the contact pressure forces over the length of the drum or its generatrix, higher specific pressing forces are possible. This effect or the control possibilities can be increased by mutually staggering the partial gaps 24 of adjacent pairs of rollers such as shown in FIG. 2.

Figure 4:
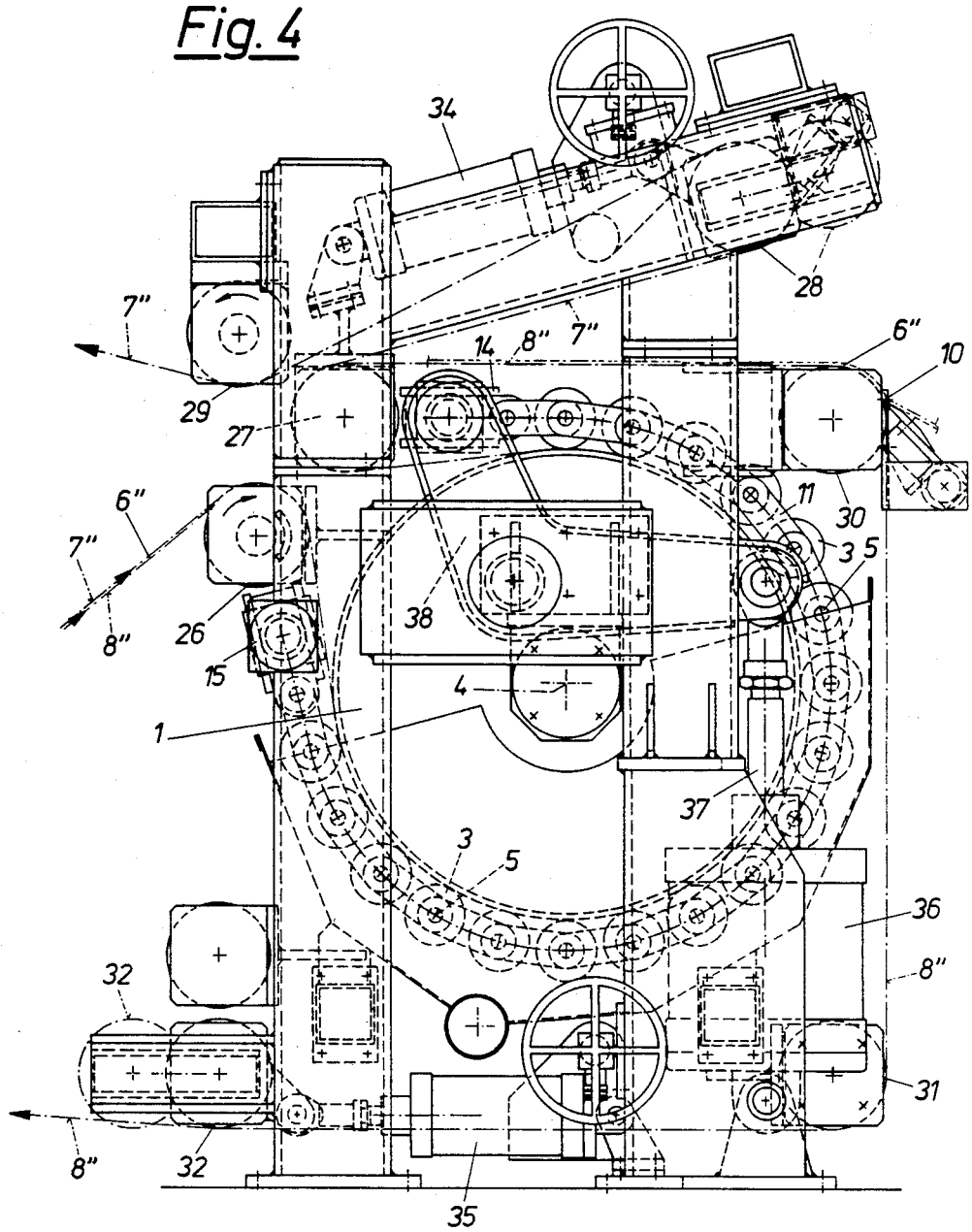
FIG. 4 shows a third variant of the invention in side elevational view.

As shown diagrammatically in the variant of FIG. 1 represented in broken lines and in FIG. 4, the lower or outer screen belt 8′ (FIG. 1) and the upper or inner screen belt 7″ and the lower or outer screen belt 8″ (FIG. 4) made to pass between the drum 1 and the roller chain 3,5,11 can form an extension of the corresponding screen belt(s) of the prepress. As a result, the prepressed web of material 6′ or 6″ is conveyed on the outer screen belt 8′ or between the screen belts 7″, 8″ to the additional press represented.

FIG. 1 shows that the press according to the invention can also be formed as an independent unit. In this case, both belts 7,8 are circulated in this independent press unit or additional press unit in an independent cycle. This circulation is effected over various rollers 26 to 33 of which some, such as the roller 26, 29, are driven, and some, such as the rollers 28, 32, are adjustable for the tensioning and control of the screen belts, for instance via pneumatic or hydraulic cylinders 34, 35.

Also shown is that the end 12 or 14 of the roller chain 3,5,11 is connected to an hydraulic cylinder 36 via machine parts 37, 38. This permits a control or change of the traction forces acting on the roller chain and thus of the compression forces acting on the screen belts 7,8 or the web of material 6 or the press cake. The parallelogram of forces P shows the conversion of the traction force F to the pressing force $F_1$ in the area of the press roller W.

A particularly convenient dehydration or pressing can be achieved if additional press clamps 39 or the like act on the roller chain 3,5,11, as shown in FIG. 5 and 6, at a distance from its ends 12, 13 and 14, 15 for an additional change or control or increase of the contact pressure force $F_1$ or $F_2$ or $F_3$. The diagram of FIG. 6 shows the possible progressive pressure increase $F_1$ to $F_3$, the pressing force $F_1$ being plotted on the ordinate and the position of the roller chain portions in question on the circumference U of the drum shell 2 being plotted on the abscissa. The aforementioned press clamps 39 which are arranged parallel to the drum axis are in this case acted on by radially extending tension springs 40 to 42 or tension cylinders which can be anchored in the press support in the area of the extended drum axis laterally outisde of the drum front faces. The tension of the tension springs 40 to 42 can be changeable or adjustable. Clamps of approximate U-shape incorporating adjustable or controllable compression elements acting on the roller chain links may be provided instead of the press clamps 39 and the aforementioned tension springs for the drum and the roller chain.

In the figures, like parts are provided with identical reference symbols. It is understood that two or more drums, in particular perforated drums, over which the screen belts and the web of material are made to pass and which are provided with the roller chains and the like can be provided instead of the one drum.

We claim:

1. A press for separating solids and liquids from solid/liquid mixtures consisting of at least one perforated and hollow rotatable drum, centrally located with the press; press rollers with axes parallel to a drum axis acting against an outershell of the drum, the press rollers including an elastically yielding surface formed of lamellas extending approximately in a direction of the generatrix of the press roller shells; at least one web of material to be pressed being made to pass between said drum and the press rollers; the web being supported by screen belts; articulated traction elements for connecting the axes of the press rollers disposed on the outer circumference of the drum; a roller chain adaptable to the outer circumference of the drum being formed from the rollers and said traction elements; anchorages, connected articulatably to ends of said roller chain; said anchorages being capable of exerting tension forces on said traction elements for changing a distance between the roller chain and the outer circumference of the drum, so that the contact pressure of the press rollers on the screen belts and the web of material lodged therebetween and on the drum shall can be established, maintained and adjusted.

2. The press according to claim 1, wherein at least two partial rollers are supported side by side in the direction of the drum generatrix on chosen roller axes, partial gaps between such partial rollers being aligned with the partial gaps of immediately adjacent rollers and intermediary traction elements.

3. The press according to claim 2, wherein some of the partial rollers of adjacent pairs of rollers are of different lengths so that the partial gaps of adjacent pairs of rollers are mutually staggered.

4. The press according to claim 1, wherein a chosen one of the lower screen belt or the upper screen belt is made to pass between the drum and the roller chain thereby constituting an extension of corresponding screen belts of a pre-press.

5. The press according to claim 1, wherein the press is formed as an independent unit and chosen ones of the screen belts are made to pass between the drum and the roller chain in a separate cycle in said independent press unit.

6. The press according to claim 1, wherein the anchorages for the ends of the traction elements are connected to pneumatic cylinders, which premit a control of the traction forces acting on the roller chain, and thus of the compression forces acting on the screen belts and web of material therebetween.

7. The press according to claim 1, further including press clamps for acting on the roller chain, spatially from ends of the roller chain to vary the contact pressure force.

8. A press for dewatering a material layer, comprising:

a frame;

a drum rotatably carried by the frame;

first and second screen belts, extending about a substantial portion of a periphery of the drum, for holding the material layer between said screen belts on the periphery of the drum;

a multiplicity of press rollers for exerting a radially inwardly directed force upon the material layer, distributed about the periphery of the drum, positioned such that the screen belts with the material layer therebetween are disposed between the drum periphery and said press rollers;

the press rollers having axes disposed substantially parallel to an axis of the drum;

articulated roller holding means rotatably supporting the press rollers about the drum periphery such that the spacing between the drum periphery and the press rollers can be changed by moving the articulated holding means;

said press rollers and said articulated holding means defining a roller chain having first and second ends; said roller chain surrounding a substantial portion of the periphery of the drum;

first and second anchor means, operatively coupled with the first and second roller chain ends respectively, for applying a tension force to the articulated holding means and to the press rollers and generating radially inwardly directed forces between the press rollers and the drum, so as to compress the material layer disposed between the first and second screen belts and effect a dewatering of the material layer; and means cooperating with the first and second anchor means for adjusting the tension force applied to the first and second roller chain ends, to the articulated roller holding means and to the press rollers for varying thereby the radially inwardly directed force acting on the material layer.

9. A press according to claim 8, further including clamping means, operatively coupled with the press rollers, for applying an additional, radially inwardly directed force to chosen ones of said press rollers.

10. A press according to claim 9, further including means for adjusting the magnitude of the additional, radially inwardly directed force.

11. A press according to claim 8, wherein the drum includes a perforated jacket.

12. A press according to claim 8, wherein the drum is hollow.

13. A press according to claim 8, further including:

pivotally connected shaft means for rotatably supporting the press rollers on the articulated roller holding means; and wherein the articulated roller holding means includes rigid one-piece members engaging the shaft means, the pivotally connected shaft means permitting the members to move relative to each other and relative to the drum.

14. A press according to claim 8, further including:

shaft means for rotatably supporting the press rollers on the articulated roller holding means; and wherein the articulated roller holding means comprises resilient members engaging the shaft means, the shaft means being connected such that the resilient members can move relative to each other and relative to the drum.

15. A press according to claim 8, wherein the press rollers include means forming an elastically yielding exterior surface.

16. A press according to claim 15, wherein the elastically yielding exterior surface includes a plurality of obliquely oriented webs extending over substantially a full axial length of the press rollers.

17. A press according to claim 8, wherein each press roller includes a plurality of axially spaced roller sections defining gaps between adjoining sections, the gaps between adjoining sections of one roller being staggered relative to gaps between adjoining sections of an adjacent roller.

18. A press according to claim 17, further including shaft means for rotatably supporting the press rollers on the articulated roller holding means; wherein the articulated roller holding means includes rigid one-piece members pivotally connected with said shaft means.

19. A press according to claim 8, wherein the first and second screen belts comprise an extension of corresponding upper and lower screen belts on a pre-press.

20. A press according to claim 8, wherein the press constitutes an independent unit; and wherein the first and second screen belts are upper and lower screen belts, respectively, and at least a chosen one of the first and second screen belts is made to pass between the drum and the roller chain in a separate cycle of the independent press unit.

* * * * *